US012012831B2

(12) United States Patent
Ejim et al.

(10) Patent No.: US 12,012,831 B2
(45) Date of Patent: Jun. 18, 2024

(54) SOLIDS BYPASS DEVICE FOR INVERTED ELECTRIC SUBMERSIBLE PUMP

(71) Applicant: SAUDI ARABIAN OIL COMPANY, Dhahran (SA)

(72) Inventors: Chidirim Enoch Ejim, Dhahran (SA); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 58 days.

(21) Appl. No.: 17/955,462

(22) Filed: Sep. 28, 2022

(65) Prior Publication Data

US 2024/0102368 A1 Mar. 28, 2024

(51) Int. Cl.
*E21B 43/12* (2006.01)
*E21B 43/38* (2006.01)

(52) U.S. Cl.
CPC ..... *E21B 43/128* (2013.01); *E21B 43/38* (2013.01)

(58) Field of Classification Search
CPC ..... E21B 43/38; E21B 43/128
See application file for complete search history.

(56) References Cited

U.S. PATENT DOCUMENTS

| | | | | |
|---|---|---|---|---|
| 9,228,414 | B2 * | 1/2016 | Xu | E21B 37/08 |
| 10,947,813 | B2 | 3/2021 | Ejim et al. | |
| 11,021,931 | B1 | 6/2021 | Arterbury et al. | |
| 11,149,524 | B2 | 10/2021 | Reed et al. | |
| 2012/0132414 | A1 * | 5/2012 | Lawson | E21B 43/128 166/105 |
| 2014/0014358 | A1 * | 1/2014 | Leitch | E21B 43/08 166/105.4 |
| 2020/0032617 | A1 * | 1/2020 | Ejim | E21B 34/10 |
| 2021/0324722 | A1 * | 10/2021 | Xiao | E21B 43/38 |
| 2022/0018236 | A1 * | 1/2022 | Newport | E21B 43/128 |

FOREIGN PATENT DOCUMENTS

| | | | |
|---|---|---|---|
| GB | 2361017 | A | 10/2001 |
| GB | 2411416 | A | 8/2005 |
| WO | 2018088910 | A1 | 5/2018 |
| WO | 2020028355 | A1 | 2/2020 |

OTHER PUBLICATIONS

International Search Report and Written Opinion for PCT Application No. PCT/US2023/074444 dated Dec. 22, 2023.

* cited by examiner

*Primary Examiner* — David Carroll
(74) *Attorney, Agent, or Firm* — Bracewell LLP; Constance G. Rhebergen; Keith R. Derrington

(57) ABSTRACT

Systems and methods for providing artificial lift to wellbore fluids includes a pump, a motor, and a protector assembly forming an electric submersible pump system located within a wellbore. A downhole packer is located downhole of the pump. A solids bypass device is located downhole of the pump. The solids bypass device has a flow tube with an inner bore, a bypass stinger that is a tubular member that circumscribes the flow tube, and drain ports extending through a sidewall of the bypass stinger. A sealing cap circumscribes the flow tube. The sealing cap is moveable between an open position, where the sealing cap is positioned to provide an external fluid flow path through the solids bypass device, and a closed position, where the sealing cap prevents fluid from traveling through the external fluid flow path. A biasing member biases the sealing cap towards the open position.

20 Claims, 9 Drawing Sheets

SOLIDS BYPASS DEVICE FOR INVERTED ELECTRIC SUBMERSIBLE PUMP

BACKGROUND OF THE DISCLOSURE

1. Field of the Disclosure

The present disclosure relates to electric submersible pumps used in hydrocarbon development operations, and more specifically, the disclosure relates to an inverted electric submersible pump completion with a downhole packer.

2. Description of the Related Art

In hydrocarbon developments, it is common practice to use electric submersible pumping systems (ESPs) as a primary form of artificial lift. As an example tubing-deployed inverted electric submersible pump systems installed between an uphole packer and downhole packer, or through-tubing cable deployed electric submersible pump systems, which sting into a polished bore receptacle can be used to provide artificial lift. During pump shutdown, sand or other solids in the wellbore can be trapped at the bottom of the completion. Frequent shutdowns result in accumulation of the trapped sand and other solids over time such that it is difficult to pull out the system during pump retrieval. Furthermore, depending on the amount of sand accumulation, the pump discharge may be blocked preventing production of hydrocarbons to the surface.

SUMMARY OF THE DISCLOSURE

Solid particles 39, such as sand, can settle directly on downhole packer 28. When pump 18 is re-started, some solid particles 39 that settled on downhole packer 28 could remain on downhole packer 28 because the uphole surface of downhole packer 28 is outside of a fluid flow path. Repeated shutdown of pump 18 would result in an accumulation of solid deposits onto downhole packer 28. After an extended period of time, the accumulated sand can fuse to the outer diameter of pump stinger 30 and pump 18. This poses a problem during retrieval of the system because the equipment would have an enlarged outer diameter that would inhibit the equipment being pulled out of wellbore 12. In very extreme cases of solid accumulation, the solid particles 39 can fill the entire annular space 34 and fluid discharge 32 and flow coupling 36 could become blocked.

Systems and methods of this disclosure reduce the risk of inverted electric submersible pump systems getting stuck as a result of solid particle accumulation during field operation. A solids bypass device is installed downhole that creates an access for the sand and other solid particles to drain downhole of the downhole packer when the pump is shut down. With the fluid that contains entrained sand being diverted downhole, embodiments of this disclosure do not require being sized or elongated to include a capacity for sand storage.

In an embodiment of this disclosure, a system for providing artificial lift to wellbore fluids includes a pump located within a wellbore. The pump is oriented to selectively boost a pressure of the wellbore fluids traveling from the wellbore towards an earth's surface through a production tubular. A motor is located within the wellbore uphole of the pump and provides power to the pump. A protector assembly is located between the pump and the motor. The pump, the motor, and the protector assembly form an electric submersible pump system. A downhole packer is located within the wellbore downhole of the pump. A fluid discharge is located between the pump and the protector assembly. The fluid discharge directs fluid out of the pump and into an annular space between an outer diameter surface of the electric submersible pump system and an inner diameter of the wellbore. A solids bypass device is located downhole of the pump, the solids bypass device has a flow tube with an inner bore and a bypass stinger. The bypass stinger is a tubular member that circumscribes the flow tube. Drain ports extend through a sidewall of the bypass stinger. A sealing cap circumscribes the flow tube. The sealing cap is moveable between an open position, where the sealing cap is positioned to provide an external fluid flow path through the solids bypass device, and a closed position, where the sealing cap prevents fluid from traveling past the solids bypass device through the external fluid flow path. The external fluid flow path is external of the flow tube. A biasing member biases the sealing cap towards the open position.

In alternate embodiments, the solids bypass device can further include a shoulder assembly, the shoulder assembly located at an uphole end of the bypass stinger. The shoulder assembly can include an uphole facing shoulder that engages a downhole facing lip of the sealing cap when the sealing cap is in the closed position. The solids bypass device can further include a collector assembly. The collector assembly can have a collector cone with a frusto conical shape. The collector cone can have a collector downhole end that engages an uphole end of the shoulder assembly, and a collector uphole end that engages an inner diameter surface of a downhole tubing. The collector uphole end can have a diameter that is larger than a diameter of the collector downhole end.

In other alternate embodiments, the collector assembly can have an elastomeric rim at the collector uphole end that contacts the inner diameter surface of the downhole tubing. The collector assembly can engage the uphole end of the shoulder assembly at a hinge, and the solids bypass device can further include a collector spring that biases the collector uphole end radially inward. The downhole tubing can be a well casing, and a pump stinger secured to the pump of the electric submersible pump system can be located within the inner bore of the flow tube that extends through the downhole packer. Alternately, the downhole tubing can be a production tubing, and a pump stinger secured to the pump of the electric submersible pump system can be located within the inner bore of the flow tube that extends out of the production tubing.

In still other alternate embodiments, the solids bypass device can further include an upper stop. The upper stop can be located on an outer diameter surface of the flow tube and be positioned to engage an uphole surface of the sealing cap when the sealing cap is in the open position. The biasing member can be a spring. The spring can circumscribe the flow tube and be positioned between an uphole facing end surface of the bypass stinger and a downhole facing surface of the sealing cap.

In alternate embodiments of this disclosure, a method for providing artificial lift to wellbore fluids includes locating a pump within a wellbore. The pump selectively boosts a pressure of the wellbore fluids traveling from the wellbore towards an earth's surface through a production tubular. A motor is located within the wellbore uphole of the pump and provides power to the pump. A protector assembly is located between the pump and the motor. The pump, the motor, and the protector assembly form an electric submersible pump system. A downhole packer is located within the wellbore downhole of the pump. A fluid discharge is located between the pump and the protector assembly. The fluid discharge directs fluid out of the pump and into an annular space between an outer diameter surface of the electric submersible pump system and an inner diameter of the wellbore. A solids bypass device is located downhole of the pump. The solids bypass device has a flow tube with an inner bore and a bypass stinger. The bypass stinger is a tubular member that circumscribes the flow tube. Drain ports extend through a sidewall of the bypass stinger. A sealing cap circumscribes the flow tube. The sealing cap is moveable between an open position where the sealing cap is positioned to provide an external fluid flow path through the solids bypass device, and a closed position where the sealing cap prevents fluid from traveling past the solids bypass device through the external fluid flow path. The external fluid flow path is external of the flow tube. A biasing member biases the sealing cap towards the open position.

In alternate embodiments, the solids bypass device can further include a shoulder assembly, the shoulder assembly located at an uphole end of the bypass stinger. The shoulder assembly can include an uphole facing shoulder and the method further includes engaging a downhole facing lip of the sealing cap with the uphole facing shoulder when the sealing cap is in the closed position.

In other alternate embodiments, the solids bypass device can further include a collector assembly. The collector assembly can have a collector cone with a frusto conical shape. The collector cone can have a collector uphole end that has a diameter that is larger than a diameter of a collector downhole end. The collector downhole end can be connected to an uphole end of the shoulder assembly. The method can further include engaging an inner diameter surface of a downhole tubing with the collector uphole end. Engaging the inner diameter surface of the downhole tubing with the collector uphole end the solids bypass device includes contacting the inner diameter surface of the downhole tubing with an elastomeric rim at the collector uphole end of the collector assembly. The collector assembly can engage the uphole end of the shoulder assembly at a hinge, and the method can further include biasing the collector uphole end radially inward with a collector spring.

In yet other alternate embodiments, the downhole tubing can be a well casing, and the method can further include locating a pump stinger that is secured to the pump of the electric submersible pump system within the inner bore of the flow tube that extends through the downhole packer. Alternately, the downhole tubing can be a production tubing, and the method can further include locating a pump stinger that is secured to the pump of the electric submersible pump system within the inner bore of the flow tube that extends out of the production tubing. The method can further include engaging an uphole surface of the sealing cap with an upper stop when the sealing cap is in the open position, the upper stop located on an outer diameter surface of the flow tube. The biasing member can be a spring, and the method can further include circumscribing the flow tube with the spring and positioning the spring between an uphole facing end surface of the bypass stinger and a downhole facing surface of the sealing cap.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

FIG. 2 is a section view of a subterranean well with an electric submersible pump system and solids bypass device in accordance with an embodiment of this disclosure, shown with a pump of the electric submersible pump system on.

FIG. 5 is a section view of a subterranean well with an electric submersible pump system and solids bypass device in accordance with an embodiment of this disclosure, shown with a pump of the electric submersible pump system on.

FIG. 10 is a section view of a solids bypass device in accordance with an embodiment of this disclosure, shown with the sealing cap in the closed position with a pump of the electric submersible pump system on.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components, or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
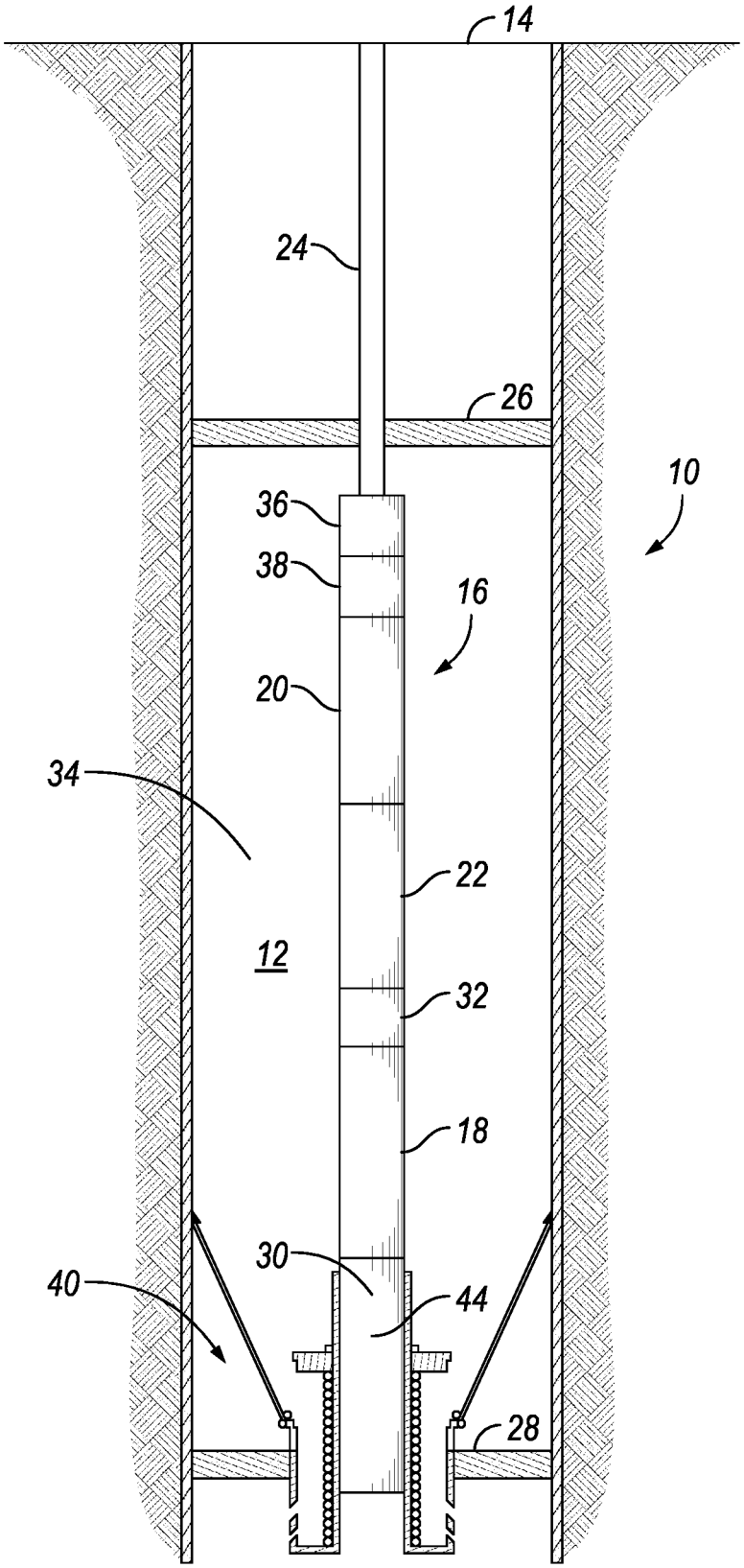
FIG. 1 is a section view of a subterranean well with an electric submersible pump system and solids bypass device in accordance with an embodiment of this disclosure.
Figure 4:
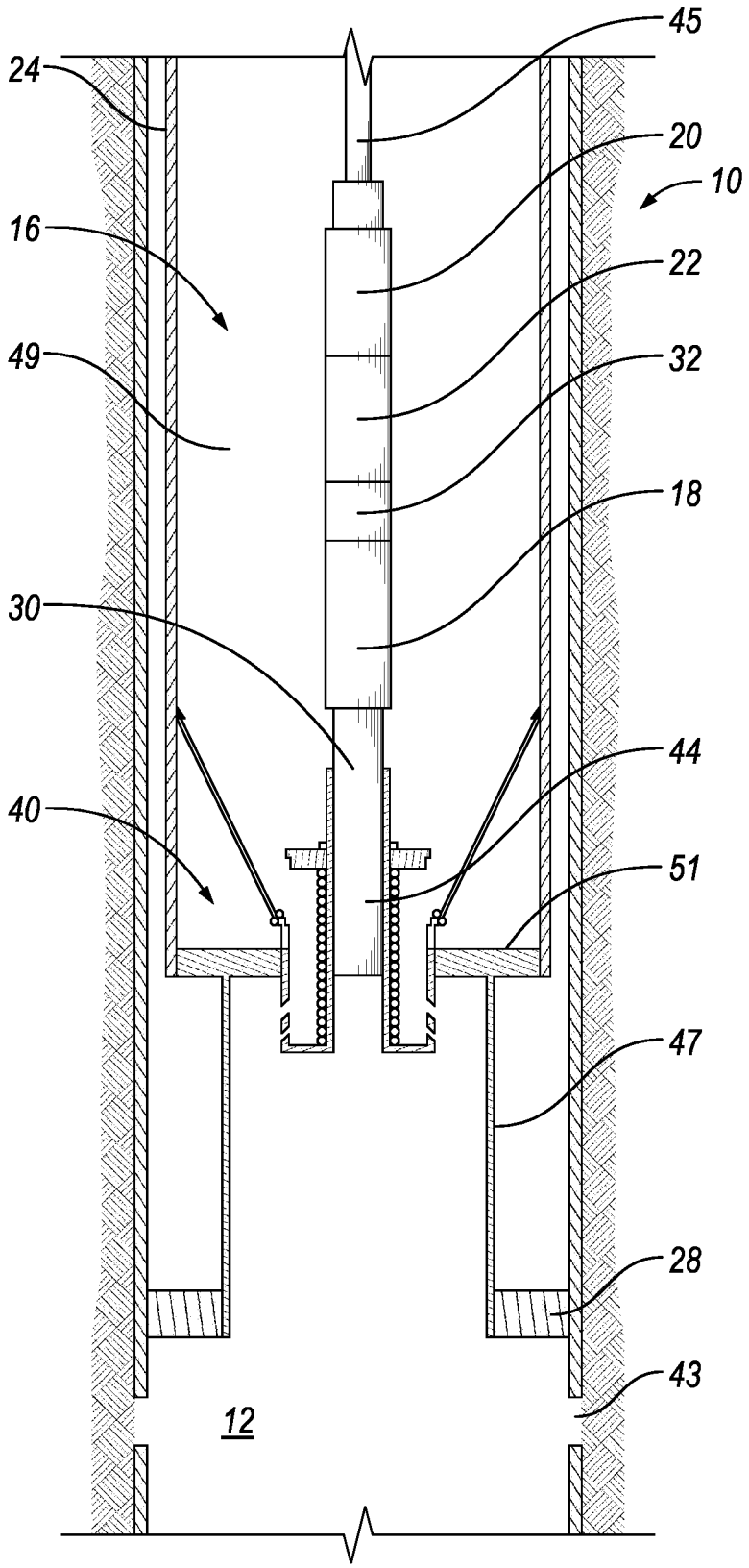
FIG. 4 is a section view of a subterranean well with an electric submersible pump system and solids bypass device in accordance with an embodiment of this disclosure.

Looking at FIGS. 1 and 4, subterranean well 10 can have wellbore 12 that extends to an earth's surface 14. Subterranean well 10 can be an offshore well or a land based well and can be used for producing fluids, such as producing hydrocarbons from subterranean hydrocarbon reservoirs. Submersible pump string 16 can be located within wellbore 12. Submersible pump string 16 can provide artificial lift to wellbore fluids. Submersible pump string 16 can include an electric submersible pump system that has pump 18, motor 20, and protector assembly 22.

Pump 18 can be, for example, a rotary pump such as a centrifugal pump. Pump 18 could alternatively be a progressing cavity pump, which has a helical rotor that rotates within an elastomeric stator or other type of pump known in the art for use with an electric submersible pump assembly. Pump 18 can consist of stages, which are made up of impellers and diffusers. The impeller, which is rotating, adds energy to the fluid to provide head and the diffuser, which is stationary, converts the kinetic energy of fluid from the impeller into head. The pump stages can be stacked in series to form a multi-stage system that is contained within a pump housing. The sum of head generated by each individual stage is summative so that the total head developed by the multi-stage system increases linearly from the first to the last stage.

Pump 18 is located within wellbore 12 and is oriented to selectively boost the pressure of the wellbore fluids traveling from the wellbore towards the earth's surface 14 so that wellbore fluids can travel more efficiently to the earth's surface 14 through production tubular 24. Production tubular 24 extends within wellbore 12 to carry wellbore fluids from downhole to the earth's surface 14.

Motor 20 is also located within wellbore 12 and provides power to pump 18. Because embodiments of this disclosure provide for an inverted electric submersible pump system, motor 20 is located uphole of pump 18. Protector assembly 22 is located between pump 18 and motor 20. Protector assembly 22 absorbs the thrust load from pump 18, transmits power from motor 20 to pump 18, equalizes pressure, receives additional motor oil as the temperature changes, and prevents wellbore fluid from entering motor 20.

In the embodiment of FIG. 1, uphole packer 26 can be used to isolate the section of wellbore 12 that is uphole of uphole packer 26 from the section of wellbore 12 that contains submersible pump string 16. Uphole packer 26 can circumscribe production tubular 24 uphole of motor 20 and can seal around an inner diameter surface of wellbore 12. Uphole packer 26 can be, for example, an electric submersible pump system feed-thru packer. In the example embodiment of FIG. 4, there may not be an uphole packer 26.

Downhole packer 28 can be located within wellbore 12 downhole of pump 18. Downhole packer 28 can be used to isolate the section of wellbore 12 that is downhole of downhole packer 28 from the section of wellbore 12 that contains submersible pump string 16. Downhole packer 28 can seal around the inner diameter surface of wellbore 12. In the embodiment of FIG. 1, downhole packer 28 can circumscribe pump stinger 30. In the embodiment of FIG. 4, downhole packer 28 can circumscribe an extended receptacle 47. Downhole packer 28 can be, for example, a polished bore receptacle type of packer, allowing a stinger of the system to sting in so that such stinger extends through downhole packer 28.

In the embodiment of FIG. 1, submersible pump string 16 can further include fluid discharge 32 that is located between pump 18 and protector assembly 22 and flow coupling 36 that is located uphole of motor 20. Fluid discharge 32 can direct fluid out of pump 18 and into annular space 34 between an outer diameter surface of the electric submersible pump system and an inner diameter of wellbore 12. Flow coupling 36 can direct fluid from annular space 34 and into production tubular 24.

In alternate embodiments, such as the embodiment of FIG. 4, submersible pump string 16 can be a through-tubing cable deployed electric submersible pump system. In such an embodiment, flow coupling 36 and uphole packer 26 may not be included. In such embodiments, fluid discharge 32 is located between pump 18 and protector assembly 22 and can direct fluid out of pump 18 and into annular space 49 between an outer diameter surface of the electric submersible pump system and an inner diameter of production tubular 24.

In certain embodiments, submersible pump string 16 can further include monitoring sub 38. Monitoring sub 38 can monitor conditions within wellbore 12 as well as monitor the operation of submersible pump string 16. Monitoring sub 38 can measure and transmit data, including pump intake and discharge temperature and pressure, motor oil and winding temperature, and vibration.

As further discussed in this disclosure, submersible pump string 16 also includes solids bypass device 40, which is located downhole of pump 18. Although solids bypass device 40 is shown as a separate component, in alternate embodiments solids bypass device 40 can be integrated with pump 18 or pump stinger 30.

Figure 2:
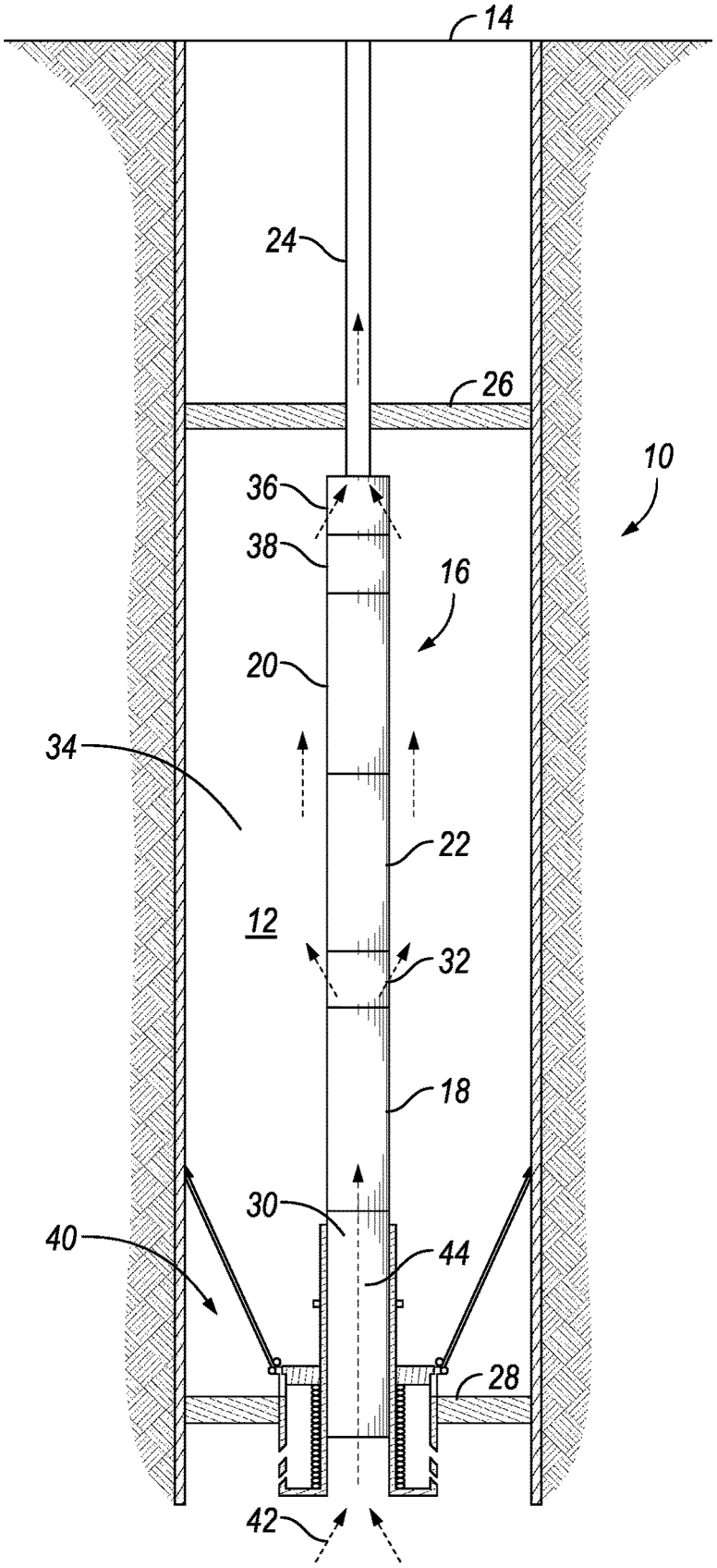
Figure 5:
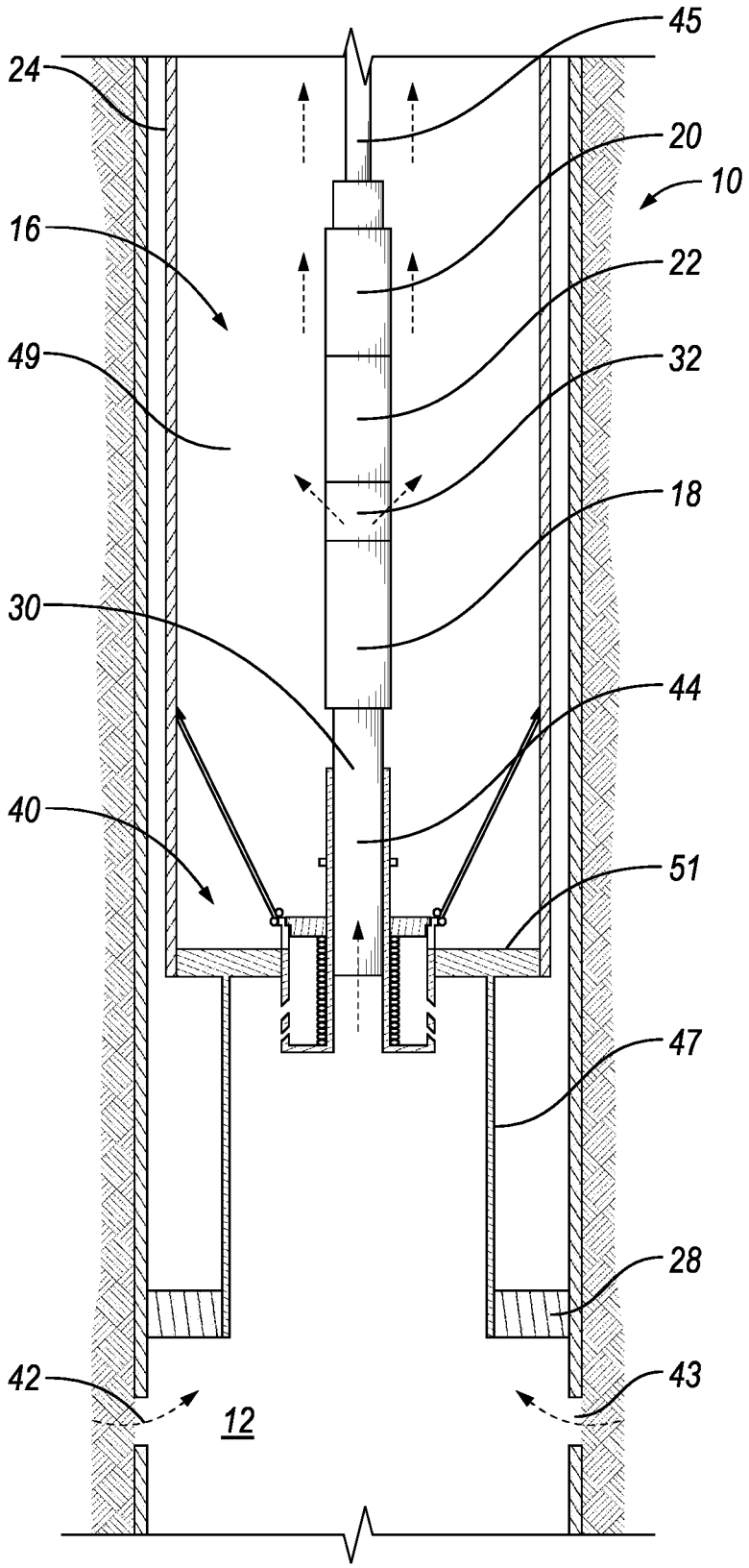

In the embodiments of FIGS. 2 and 5, pump 18 is on so that pump 18 is boosting the pressure of the wellbore fluids within wellbore 12 to assist the wellbore fluids in traveling in an uphole direction towards surface 14. As indicated by arrows 42, reservoir fluids will travel from perforations 43 downhole of downhole packer 28 and into stinger inner bore 44 of pump stinger 30. Wellbore fluids passing into stinger inner bore 44 reach pump 18.

In the embodiment of FIG. 2, after passing through pump 18, fluid discharge 32 directs the wellbore fluid out of pump 18 and into annular space 34. The wellbore fluid continues to travel in an uphole direction past protector assembly 22, motor 20, and monitoring sub 38 and then flow coupling 36 directs the wellbore fluid from annular space 34 into production tubular 24 to be produced to the surface and treated and processed using conventional methods.

In the embodiment of FIG. 5, after passing through pump 18, fluid discharge 32 directs the wellbore fluid out of pump 18 and into annular space 49 of production tubular 24. The wellbore fluid continues to travel in an uphole direction past protector assembly 22, motor 20, and monitoring sub 38 within production tubular 24 to be produced to the surface and treated and processed using conventional methods.

Figure 3:
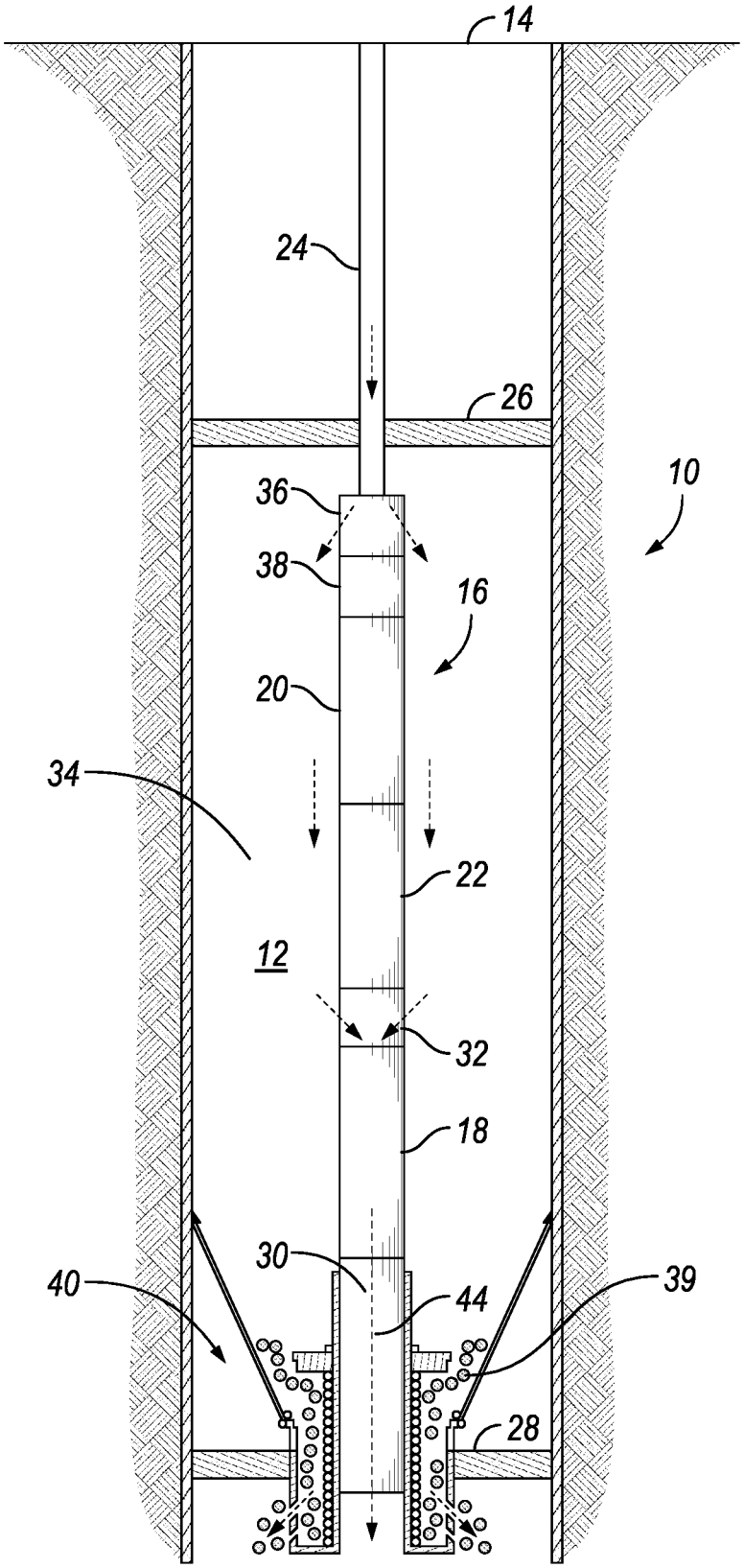
FIG. 3 is a section view of a subterranean well with an electric submersible pump system and solids bypass device in accordance with an embodiment of this disclosure, shown with a pump of the electric submersible pump system off.
Figure 6:
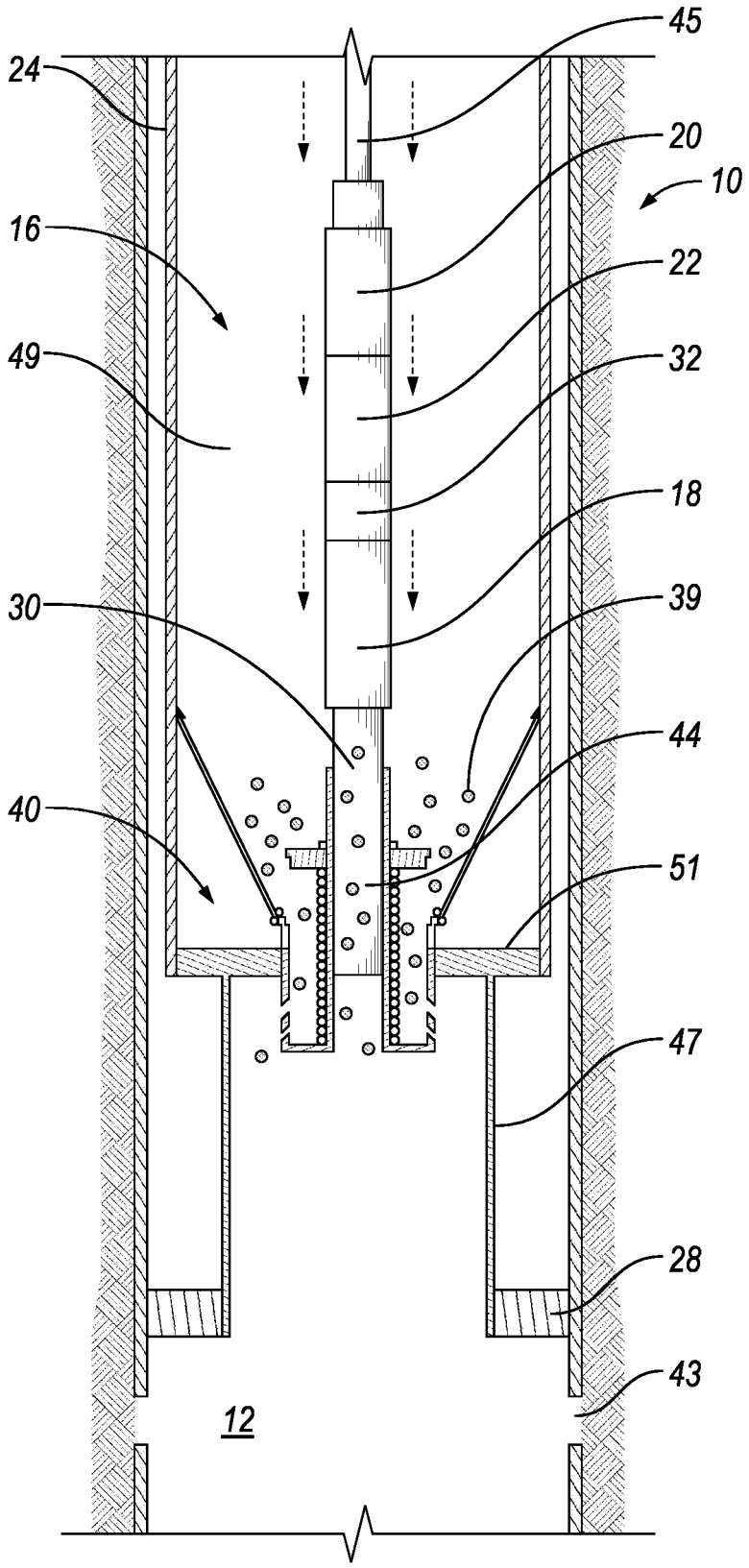
FIG. 6 is a section view of a subterranean well with an electric submersible pump system and solids bypass device in accordance with an embodiment of this disclosure, shown with a pump of the electric submersible pump system off.

Looking at FIGS. 3 and 6, pump 18 is off, either intentionally or otherwise. With pump 18 off, the column of wellbore fluid within production tubular 24 moves in a direction downhole under the force of gravity. The wellbore fluid, including any solid particles 39, will pass by monitoring sub 38, motor 20, and protector assembly 22, and can enter fluid discharge 32, which will direct fluid into pump 18. From pump 18 the wellbore fluid and any solid particles 39 can flow through stinger inner bore 44 and exit pump stinger 30 downhole of downhole packer 28. Wellbore fluid and solid particles 39 that do not enter fluid discharge 32 can alternately remain within annular space 34 and continue to travel in a downhole direction towards downhole packer 28 or upward facing surface 51 of production tubular 24, as applicable.

In currently available systems, solid particles 39 such as sand, can settle directly on downhole packer 28 or upward facing surface 51 of production tubular 24. After an extended period of time, the accumulated solid particles can accumulate in the annular space and fluid discharge 32 could become blocked. In order to avoid such solids accumulation, solids bypass device 40, which is located downhole of pump 18, can direct solid particles 39 downhole past downhole packer 28.

Figure 7:
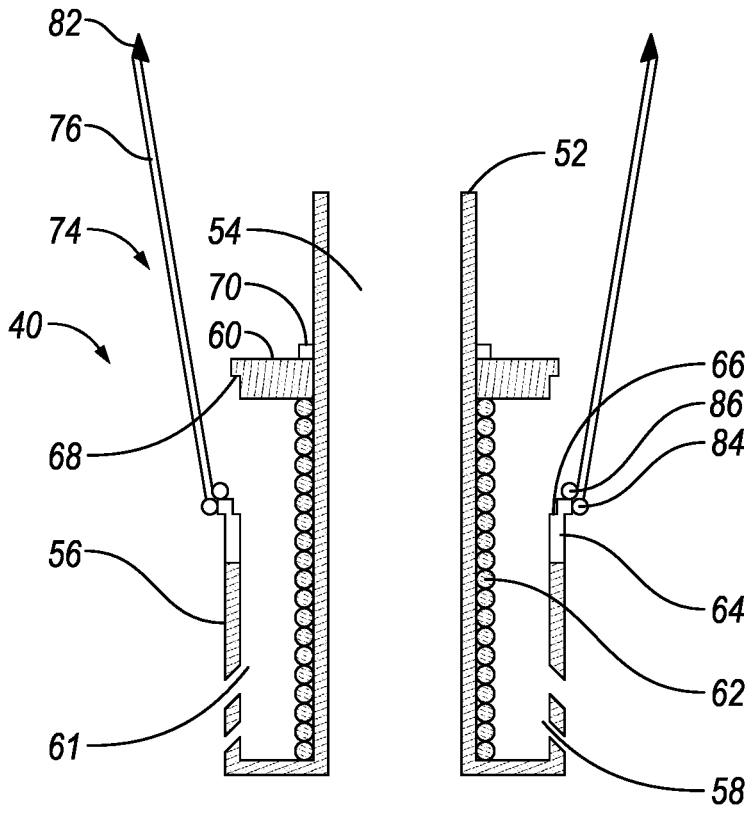
FIG. 7 is a section view of a solids bypass device in accordance with an embodiment of this disclosure, shown with the sealing cap in the open position before installation within the subterranean well.
Figure 8:
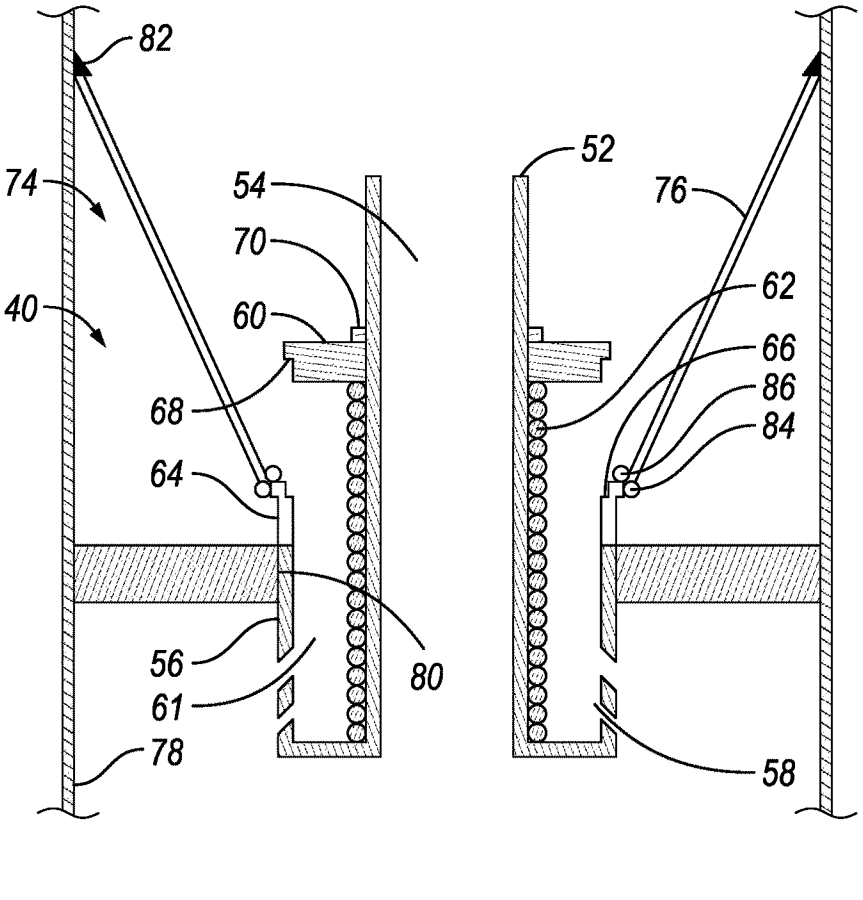
FIG. 8 is a section view of a solids bypass device in accordance with an embodiment of this disclosure, shown with the sealing cap in the open position.

Looking at FIGS. 7-8, solids bypass device 40 can provide a flow path for solid particles 39 to pass downhole of downhole packer 28 or upward facing surface 51 of production tubular 24, as applicable, when pump 18 is turned off. Solids bypass device 40 includes flow tube 52 that has an inner bore 54. As can be seen in FIGS. 1 and 4, the inner bore 54 of flow tube 52 is sized to provide a close fit with an outer diameter of pump stinger 30. The inner bore 54 of flow tube 52 is the conduit through which the flow of fluids and any solids flowing in an uphole direction enters the solids bypass device 40 and is transported to pump 18. Inner bore 54 of flow tube 52 may be lined with a sealing surface or material to allow for the latching and proper fit of another external component within inner bore 54.

As seen in FIGS. 7-8, bypass stinger 56 is a tubular shaped member that circumscribes flow tube 52. Bypass stinger 56 is sized to fit within receptacle member 80. In the embodiment of FIG. 1, bypass stinger 56 latches into receptacle member 80 that is an inner bore of downhole packer 28. The outer surface of bypass stinger 56 can provide a close fit and seal with the inner bore of downhole packer 28. In the embodiment of FIG. 4, bypass stinger 56 latches into latches into receptacle member 80 that is an inner bore of the downhole surface of production tubular 24. The outer surface of bypass stinger 56 can provide a close fit and seal with the inner bore of the downhole surface of production tubular 24.

Looking at FIG. 7, drain ports 58 extend through a sidewall of bypass stinger 56. Drain ports 58 allow fluids and solids to flow downhole of downhole packer 28 or upward facing surface 51 of production tubular 24, as applicable.

Sealing cap 60 circumscribes flow tube 52. Sealing cap 60 is a generally disk shaped member. Sealing cap 60 is moveable between an open position, shown in FIGS. 7, 8, and 11, and a closed position of FIG. 10. In the open position, sealing cap 60 is positioned to provide an external fluid flow path 61 through solids bypass device 40. External fluid flow path 61 is within bypass stinger 56 external of flow tube 52. In the closed position, sealing cap 60 prevents fluid from traveling past solids bypass device 40 through external fluid flow path 61.

Biasing member 62 biases sealing cap 60 towards the open position. In the example embodiments, biasing member 62 is a spring. The spring circumscribes flow tube 52. A downhole end of the spring engages an uphole facing end surface of bypass stinger 56. An uphole end of the spring engages a downhole facing surface of sealing cap 60.

Biasing member 62 provides the force required to lift sealing cap 60 towards the open position, when sealing is not required. Because biasing member 62 is immersed in well fluid, biasing member 62 can be made of high performance alloy material, such as a nickel-chromium alloy, a nickel-chromium-molybdenum alloy, Hastelloy®, or other material that is resistance to attack of certain wellbore corrosive fluids. The material forming biasing member 62 can also be anti-scale sticking or adhering, erosion resistant, and abrasion resistant. The material forming biasing member 62 should also have excellent structural and cyclic loading properties to withstand the potential cycling that biasing member 62 will experience during operation of solids bypass device 40 downhole.

Shoulder assembly 64 is located at an uphole end of bypass stinger 56. Shoulder assembly 64 includes uphole facing shoulder 66. Uphole facing shoulder 66 engages downhole facing lip 68 of sealing cap 60 when sealing cap 60 is in the closed position of FIG. 10. The engagement of uphole facing shoulder 66 of shoulder assembly 64 with downhole facing lip 68 of sealing cap 60 acts as a downhole stop, limiting movement of sealing cap 60 in the downhole direction. The engagement of uphole facing shoulder 66 of shoulder assembly 64 with downhole facing lip 68 of sealing cap 60 prevents the passage of fluid and any solids through external fluid flow path 61 of solids bypass device 40.

Upper stop 70 is located on an outer diameter surface of flow tube 52. Upper stop 70 can be a ring shaped member that can engage an uphole surface of sealing cap 60. The engagement of sealing cap 60 with upper stop 72 acts as an uphole stop, limiting movement of sealing cap 60 in the uphole direction. Sealing cap 60 engages upper stop 70 when sealing cap 60 is in the open position.

Collector assembly 74 is located at an uphole end of solids bypass device 40. Collector assembly 74 of solids bypass device 40 includes collector cone 76. Collector cone 76 has a frusto conical shape. A downhole end of collector cone 76 engages and is secured to an uphole end of shoulder assembly 64. The collector cone uphole end has a diameter that is larger than a diameter of the collector cone downhole end. Collector cone 76 funnels any solids of fluid towards the drain ports 58.

The uphole end of collector cone 76 engages an inner diameter surface of downhole tubing 78. Solids bypass device 40 can have an elastomeric rim 82 at the uphole end of collector cone 76 that contacts the inner diameter surface of downhole tubing 78. Elastomeric rim 82 acts as a filler to close the gap between collector cone 76 and the internal diameter of downhole tubing 78. This prevents solids from migrating into the space external of collector assembly 74 on receptacle member 80.

In example embodiments, such as the embodiments of FIGS. 1-3, downhole tubing 78 can be a well casing and receptacle member 80 is downhole packer 28. In such embodiments, pump stinger 30 is located within inner bore 54 of the flow tube 52 that extends through downhole packer 28.

In alternate example embodiments, such as the embodiments of FIGS. 4-6, downhole tubing 78 is production tubular 24, and receptacle member 80 is a downhole surface of production tubular 24. In such embodiments, pump stinger 30 is located within an inner bore of the downhole surface of production tubular 24.

Collector assembly 74 engages the uphole end of shoulder assembly 64 at hinge 84. Collector spring 86 biases the collector cone uphole end radially inward, as shown in FIG. 7. Hinge 84 allows for expansion and contraction of collector cone 76 in a radial direction, as can be seen from the comparison of the configuration of collector cone 76 in FIG. 7 to the configuration of collector cone in FIG. 8. This ability for the sides of collector cone 76 to tilt facilitates trouble-free installation and retrieval, especially in scenarios where there is a risk of sticking due to changing internal dimensions within downhole tubing 78.

Collector spring 86 can be made of high performance alloy material, such as a nickel-chromium alloy, a nickel-chromium-molybdenum alloy, Hastelloy®, or other material that is resistance to attack of certain wellbore corrosive fluids. The material forming collector spring 86 can also be anti-scale sticking or adhering, erosion resistant, and abrasion resistant. The material forming collector spring 86 should also have excellent structural and cyclic loading properties to withstand the potential cycling that collector spring 86 will experience during operation of solids bypass device 40 downhole.

Looking at FIG. 7, at the surface and before installation of solids bypass device 40 in subterranean well 10, the force of biasing member 62 still biases sealing cap 60 to the open position so that sealing cap 60 engages upper stop 70. Collector spring 86 biases collector cone 76 uphole end radially inward.

Looking at FIG. 8, when solids bypass device 40 is located at the final setting depth and pump 18 is off the force of biasing member 62 still biases sealing cap 60 to the open position so that sealing cap 60 engages upper stop 70. The fluid pressure at this depth acts vertically downwards on the upward facing surface of collector cone 76, tilting elastomeric rim 82 towards the inner diameter surface of downhole tubing 78. The surfaces of collector cone 76 rotate radially outward about hinge 84. In this position, the uphole end of collector cone 76 is rotated fully radially outward, with the elastomeric rim 82 making contact with the inner wall of downhole tubing 78. As a result collector spring 86 is stretched or extended and will remain in this position due to the fluid force acting in a downhole direction on the upward facing surfaces of collector cone 76.

Figure 9:
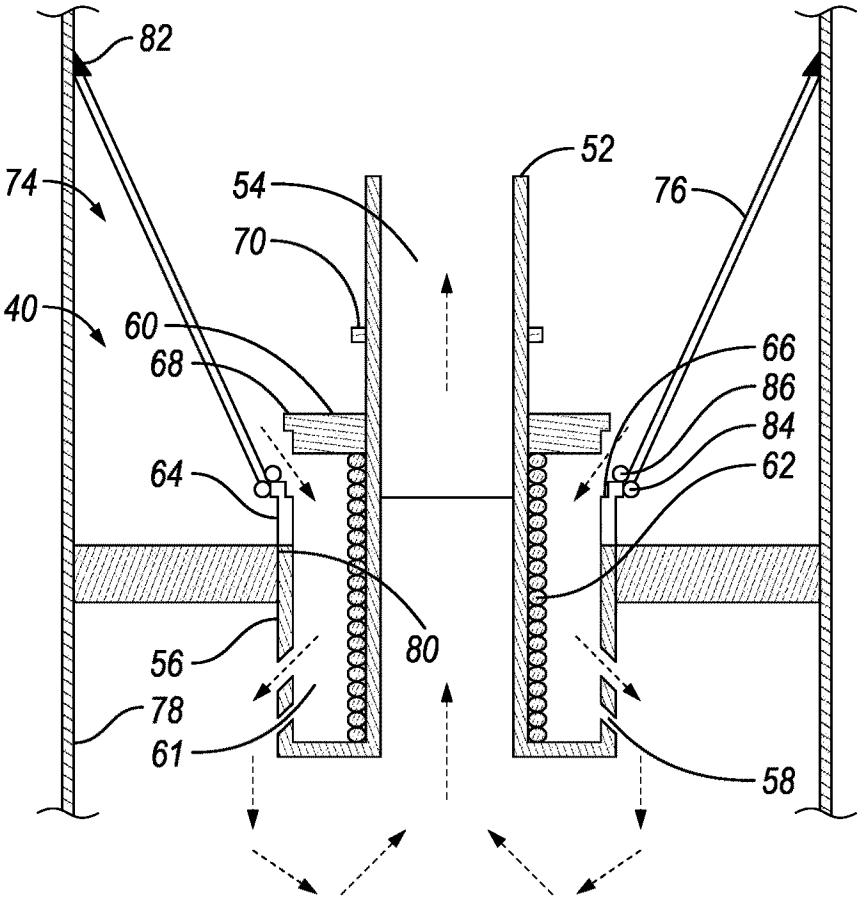
FIG. 9 is a section view of a solids bypass device in accordance with an embodiment of this disclosure, shown with the sealing cap moving from the open position to the closed position.

Looking at FIG. 9, when pump 18 is turned on, the suction of pump 18 causes an amount of fluid flow through external fluid flow path 61 of bypass stinger 56 in a downhole direction. The region downhole of sealing cap 60 experiences a pressure reduction relative to the region immediately uphole of seal cap 60. This is due to the conservation of energy since the increasing volume flow rate through the region near drain ports 58 results in a corresponding lower static pressure.

Because of these pressure changes, the forces acting on sealing cap 60 are unbalanced and there is a net force on sealing cap 60 in a downhole direction. The net forces acting on sealing cap 60 are sufficient to overcome the biasing force of biasing member 62 and sealing cap 60 moves in a downhole direction. This movement of sealing cap 60 compresses biasing member 62. The increase in pressure also results in additional force that pushes down further on the upward facing surface of collector cone 76 so that elastomeric rim 82 maintains contact with the inner diameter surface of downhole tubing 78.

Figure 10:
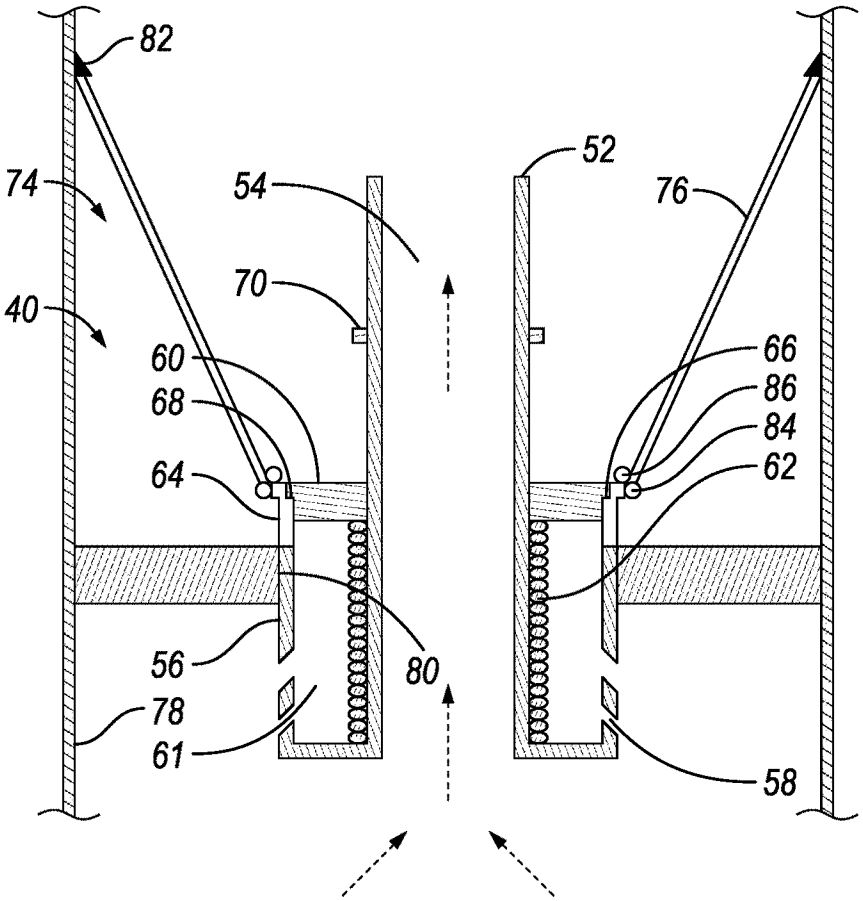

Looking at FIG. 10, continued operation of pump 18 and increased flow through the pump causes pressure at drain ports 58 to be lowered even further and sealing cap 60 moves to the full closed position. In the closed position of FIG. 10, downhole facing lip 68 of sealing cap 60 rests on uphole facing shoulder 66. The engagement of downhole facing lip 68 with uphole facing shoulder 66 seals external fluid flow path 61 so that all fluid flow through solids bypass device 40 is by way of inner bore 54. The continued pressure on the upward facing surface of collector cone 76 retains elastomeric rim 82 in contact with the inner diameter surface of downhole tubing 78.

Figure 11:
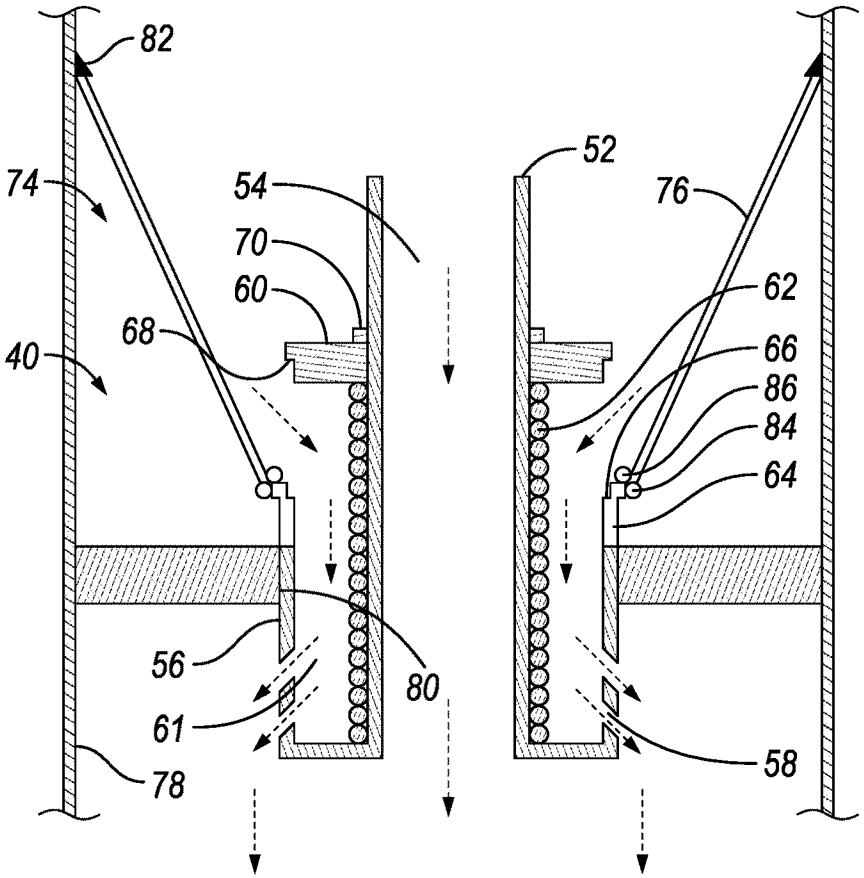
FIG. 11 is a section view of a solids bypass device in accordance with an embodiment of this disclosure, shown with the sealing cap in the open position with a pump of the electric submersible pump system off.

Looking at FIG. 11, when pump 18 is turned off, the volume flow rate of fluids through pump 18 is reduced. Fluids and any solids within wellbore 12 can flow in a downhole direction by the force of gravity. The pressure in the vicinity of drain ports 58 increases to a maximum pressure at the depth of installation of solids bypass device 40, in accordance with energy conservation. Due to removal of the pressure source from pump 18, the net differential pressure across sealing cap 60 decreases. With the fluid pressure equalizing across sealing cap 60, the biasing force of biasing member 62 pushes sealing cap 60 in an uphole direction until sealing cap 60 engages upper stop 70. With sealing cap 60 in the open position, fluids and any solids carried by the fluids that are within annular space 34 or annular space 49, as applicable, can be directed by collector cone 76 through external fluid flow path 61 and out drain ports 58 to return downhole of downhole packer 28.

Upon retrieval of solids bypass device 40 to the surface, the fluid hydrostatic pressure decreases. This reduces the pressure that pushes on the upward facing surface of collector cone 76. Collector spring 86 then biases collector cone 76 uphole end radially inward, as shown in FIG. 7.

In an example of operation and looking at Figures land 4, in order to provide artificial lift to wellbore fluids submersible pump string 16 can be set within wellbore 12. Solids bypass device 40 can either be previously set within wellbore 12 or can be delivered downhole with submersible pump string 16. Before pump 18 is turned on, sealing cap 60 is in the open position.

Looking at FIGS. 2 and 5, when pump 18 is running, sealing cap 60 is in the closed position and produced fluids travel through inner bore 54 of flow tube 52. The produced fluids is directed into production tubular 24 to be produced to the surface.

Looking at FIGS. 3 and 6, when pump 18 is turned off, sealing cap 60 is moved to the open position. Solid particles 39 that are suspended in the wellbore fluid within annular space 34 or annular space 49, as applicable, can be directed by collector cone 76 through external fluid flow path 61 and out drain ports 58 to return downhole of downhole packer 28. When pump 18 is re-started, sealing cap 60 moves back to the closed position, as described in this disclosure.

Embodiments described in this disclosure prevent solids buildup in the annulus for two-packer tubing-deployed, inverted electric submersible pump system, and through-tubing cable deployed electric submersible pump systems during shut-downs. Systems and method of this disclosure prevent a majority of solids flow back through the pump of the electric submersible pump system during shut-downs, which may cause failure. The solids bypass device therefore increases the run life of the inverted electric submersible pump system and reduces expensive workover costs due to issues associated with solids fallback during electric submersible pump system retrieval. Systems and methods of this disclosure are simple and can be integrated into current inverted electric submersible pump system architecture.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for providing artificial lift to wellbore fluids, the system having:

a pump located within a wellbore, the pump oriented to selectively boost a pressure of the wellbore fluids traveling from the wellbore towards an earth's surface through a production tubular;

a motor located within the wellbore uphole of the pump and providing power to the pump;

a protector assembly located between the pump and the motor, where the pump, the motor, and the protector assembly form an electric submersible pump system;

a downhole packer located within the wellbore downhole of the pump;

a fluid discharge located between the pump and the protector assembly, the fluid discharge directing fluid out of the pump and into an annular space between an outer diameter surface of the electric submersible pump system and an inner diameter of the wellbore; and a solids bypass device located downhole of the pump, the solids bypass device having:

a flow tube with an inner bore;

a bypass stinger, the bypass stinger being a tubular member that circumscribes the flow tube;

drain ports extending through a sidewall of the bypass stinger;

a sealing cap that circumscribes the flow tube, the sealing cap moveable between an open position where, the sealing cap is positioned to provide an external fluid flow path through the solids bypass device, and a closed position where the sealing cap prevents fluid from traveling past the solids bypass device through the external fluid flow path, where the external fluid flow path is external of the flow tube; and a biasing member that biases the sealing cap towards the open position.

2. The system of claim 1, where the solids bypass device further includes a shoulder assembly, the shoulder assembly located at an uphole end of the bypass stinger.

3. The system of claim 2, where the shoulder assembly includes an uphole facing shoulder that engages a downhole facing lip of the sealing cap when the sealing cap is in the closed position.

4. The system of claim 2, where the solids bypass device further includes a collector assembly, the collector assembly having a collector cone with a frusto conical shape, the collector cone has a collector downhole end that engages an uphole end of the shoulder assembly, and a collector uphole end that engages an inner diameter surface of a downhole tubing, where the collector uphole end has a diameter that is larger than a diameter of the collector downhole end.

5. The system of claim 4, where the collector assembly has an elastomeric rim at the collector uphole end that contacts the inner diameter surface of the downhole tubing.

6. The system of claim 4, where the collector assembly engages the uphole end of the shoulder assembly at a hinge, and where the solids bypass device further includes a collector spring that biases the collector uphole end radially inward.

7. The system of claim 4, where the downhole tubing is a well casing, and where a pump stinger secured to the pump of the electric submersible pump system is located within the inner bore of the flow tube that extends through the downhole packer.

8. The system of claim 4, where the downhole tubing is a production tubing, and where a pump stinger secured to the pump of the electric submersible pump system is located within the inner bore of the flow tube that extends out of the production tubing.

9. The system of claim 1, where the solids bypass device further includes an upper stop, the upper stop located on an outer diameter surface of the flow tube and is positioned to engage an uphole surface of the sealing cap when the sealing cap is in the open position.

10. The system of claim 1, where the biasing member is a spring, and where the spring circumscribes the flow tube and is positioned between an uphole facing end surface of the bypass stinger and a downhole facing surface of the sealing cap.

11. A method for providing artificial lift to wellbore fluids, the method including:

locating a pump within a wellbore, the pump selectively boosting a pressure of the wellbore fluids traveling from the wellbore towards an earth's surface through a production tubular;

locating a motor within the wellbore uphole of the pump and providing power to the pump with the motor;

locating a protector assembly between the pump and the motor, where the pump, the motor, and the protector assembly form an electric submersible pump system;

locating a downhole packer within the wellbore downhole of the pump;

locating a fluid discharge between the pump and the protector assembly, the fluid discharge directing fluid out of the pump and into an annular space between an outer diameter surface of the electric submersible pump system and an inner diameter of the wellbore; and locating a solids bypass device downhole of the pump, the solids bypass device having:

a flow tube with an inner bore;

a bypass stinger, the bypass stinger being a tubular member that circumscribes the flow tube;

drain ports extending through a sidewall of the bypass stinger;

a sealing cap that circumscribes the flow tube, the sealing cap moveable between an open position where the sealing cap is positioned to provide an external fluid flow path through the solids bypass device, and a closed position where the sealing cap prevents fluid from traveling past the solids bypass device through the external fluid flow path, where the external fluid flow path is external of the flow tube; and a biasing member that biases the sealing cap towards the open position.

12. The method of claim 11, where the solids bypass device further includes a shoulder assembly, the shoulder assembly located at an uphole end of the bypass stinger.

13. The method of claim 12, where the shoulder assembly includes an uphole facing shoulder and the method further includes engaging a downhole facing lip of the sealing cap with the uphole facing shoulder when the sealing cap is in the closed position.

14. The method of claim 12, where the solids bypass device further includes a collector assembly, the collector assembly having a collector cone with a frusto conical shape, the collector cone having a collector uphole end that has a diameter that is larger than a diameter of a collector downhole end, where the collector downhole end is connected to an uphole end of the shoulder assembly, and where the method further includes engaging an inner diameter surface of a downhole tubing with the collector uphole end.

15. The method of claim 14, where engaging the inner diameter surface of the downhole tubing with the collector uphole end of the solids bypass device includes contacting the inner diameter surface of the downhole tubing with an elastomeric rim at the collector uphole end of the collector assembly.

16. The method of claim 14, where the collector assembly engages the uphole end of the shoulder assembly at a hinge, and where the method further includes biasing the collector uphole end radially inward with a collector spring.

17. The method of claim 14, where the downhole tubing is a well casing, and where the method further includes locating a pump stinger that is secured to the pump of the electric submersible pump system within the inner bore of the flow tube that extends through the downhole packer.

18. The method of claim 14, where the downhole tubing is a production tubing, and where the method further includes locating a pump stinger that is secured to the pump of the electric submersible pump system within the inner bore of the flow tube that extends out of the production tubing.

19. The method of claim 11, further including engaging an uphole surface of the sealing cap with an upper stop when the sealing cap is in the open position, the upper stop located on an outer diameter surface of the flow tube.

20. The method of claim 11, where the biasing member is a spring, and where the method further includes circumscribing the flow tube with the spring and positioning the spring between an uphole facing end surface of the bypass stinger and a downhole facing surface of the sealing cap.

* * * * *